US006773284B2

(12) United States Patent
Shah

(10) Patent No.: US 6,773,284 B2
(45) Date of Patent: Aug. 10, 2004

(54) LAMP TUBE CONVERSION APPARATUS

(75) Inventor: Suresh H. Shah, Thane (IN)

(73) Assignee: Westinghouse Lighting Corporation, Philadelphia, PA (US)

( * ) Notice: Subject to any disclaimer, the term of this patent is extended or adjusted under 35 U.S.C. 154(b) by 0 days.

(21) Appl. No.: 10/353,122

(22) Filed: Jan. 28, 2003

(65) Prior Publication Data

US 2003/0224642 A1 Dec. 4, 2003

Related U.S. Application Data

(60) Provisional application No. 60/435,996, filed on Dec. 26, 2002, provisional application No. 60/402,045, filed on Aug. 9, 2002, provisional application No. 60/369,874, filed on Apr. 5, 2002, and provisional application No. 60/363,312, filed on Mar. 12, 2002.

(51) Int. Cl.[7] ..... H01R 33/02
(52) U.S. Cl. ..... 439/236; 439/234; 439/235
(58) Field of Search ..... 439/236, 234, 439/235, 638, 247, 248

(56) References Cited

U.S. PATENT DOCUMENTS 3,562,511 A * 2/1971 Reeves ..... 439/234
5,006,970 A * 4/1991 Mackiewicz ..... 362/217
6,624,554 B2 * 9/2003 Holzer ..... 313/318.01

* cited by examiner

*Primary Examiner*—Cary Pauman
(74) *Attorney, Agent, or Firm*—Drinker Biddle & Reath LLP

(57) ABSTRACT

The present invention is a kit for adapting a tube lamp fixture made for a first size of lamp tubes into a fixture that accommodates smaller lamp tubes. The kit comprises a conversion apparatus that itself comprises a bar in which are disposed one or more plugs for connecting to the sockets in the existing tube lamp fixture, said plugs being slidably disposed on the bar to adapt to the position of the sockets in the fixture. The conversion apparatus further comprises one or more slidably disposed sockets on the opposite side of the bar that may be positioned independently from the plugs. Appropriate wiring permits the supply of electrical energy to the tube lamps. The invention further comprises a master-slave ballast conversion assembly. The ballast conversion assembly comprises a chain of circuit boards connected by cables and connectors that enable a single ballast to control two or more tubes through a chain of circuit boards.

2 Claims, 11 Drawing Sheets

LAMP TUBE CONVERSION APPARATUS

This application claims priority from the following provision applications: 60/402,045; 60/435,996; 60/369,874; 60/363,312; each of which is incorporated herein by reference.

FIELD OF THE INVENTION

The invention relates to the field of electrical lighting fixtures. More particularly, the invention is related to ceiling and wall-mounted tube-type lamp mounting fixtures, such as those employed to hold fluorescent lamp tubes.

BACKGROUND OF THE INVENTION

Fluorescent lamp tubes have been used to light schools, offices and industrial sites for decades. Recently, the need to provide more efficient lamps has driven the design of new tube-type lamps that emit either the same or higher lumen energy using less electrical power than previous lamps. For example, those skilled in the art will recognize that older T-8 and T-12 lamps can be replaced by new T-5 lamps that can emit more lumens of light energy while consuming less power than their older and larger predecessors.

One consequence of the popularity of the new T-5 lamp is the need for new mounting assemblies. The T-5 is not only a smaller diameter lamp tube, but it is also slightly shorter than its older counterparts and will not fit in a mounting assembly (or "reflector" or "fixture") that was designed for the T-8 and T-12 lamps. Thus, if a facility manager decides to change over from T-8 or T-12 lamps to T-5 lamps, it has been necessary to replace all of the reflector assemblies in a facility so that the smaller, shorter T-5 lamp can be installed. As a consequence, replacing old lamps has required replacement of old fixtures as well, a cost factor that acts as a disincentive to changing from the older, less efficient lamps to the newer and much more efficient types.

SUMMARY OF THE INVENTION

The present invention is a conversion apparatus that enables the conversion of a standard fluorescent lamp reflector fixture to accommodate the newer T-5 lamp without replacement of the entire fixture. In use, the invention features a pair of identical conversion apparatus, each having one or more plug/receptacle combinations. The plug/receptacle combinations are situated on opposite surfaces of a bar, the plug on one side and the receptacle on the other. The plug is sized for the original size light tube for which the lamp assembly was designed; that is, if the fixture was intended for T-8 tubes, the plug(s) on the adapter is(are) a T-8 sized plug. The receptacle (also referred to as "socket"), located on the opposite side of the bar, is sized to receive the new, smaller and shorter lamp, such as a T-5. The bar contains wiring to connect the plug and the receptacle, providing the energizing electrical power signal from the lamp ballast to the lamp(s). Two of the conversion apparatus are mounted in a lighting fixture to change the fixture's configuration from the older lamp size to accommodate the newer lamps.

Another important feature of the apparatus of the invention is that the plug and receptacle combinations, though mounted on opposite sides of the bar, are mounted independent from each other. Each can be moved laterally along the bar without regard to the position of the other. In this manner, variations in the spacing of the receptacles in a mounting fixture can be accommodated by adjusting the position of the plugs on the adjustable conversion apparatus. In the same fashion, the ultimate positioning of the new lamp tubes relative to each other can be set by adjusting the location of the receptacles on the conversion apparatus.

The invention further comprises a series-connected master-slave ballast configuration and cable apparatus. In the conversion of an existing fluorescent lamp assembly to a new configuration, new electronics are installed in the lamp fixture to convert the ballast in the existing fixture to provide the appropriate power for the new lamp tubes. The old ballasts remain and provide the basic power signals. New circuit boards are installed in the fixture to provide the correct power supply, heater and oscillator signals to the new lamps. A shield for protecting the circuit boards is provided for installation in the existing fixture along with the plug/receptacle conversion assembly. A series connection cable designed specifically for connecting the new circuits to provide a master-slave ballast configuration is also provided.

DETAILED DESCRIPTION OF THE INVENTION

Figure 1:
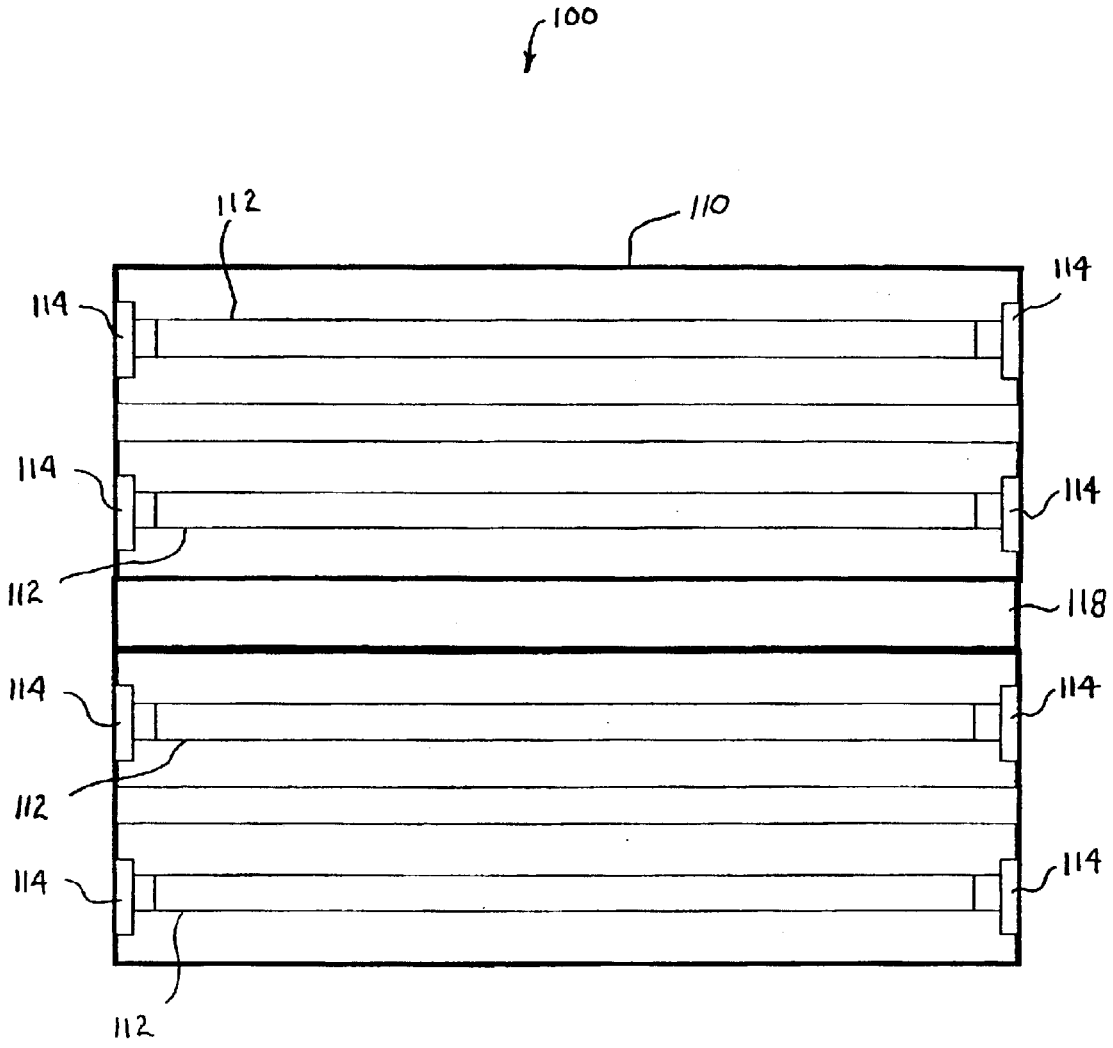
FIG. 1 is a bottom plan view of a standard lamp tube lighting assembly with the lamps shown.

FIG. 1 is an illustration of a standard lamp tube mounting assembly 100, also referred to as a fixture or a reflector. In many assemblies a diffuser, a plastic or glass panel for diffusing the emitted light, closes the fixture such that the lamp tubes cannot be seen. In FIG. 1, the fixture comprises a housing 110 commonly mounted in the ceiling (or a wall) with its outer surface flush with the ceiling (wall). The remainder of this description is written with reference to a ceiling fixture, though wall fixtures are intended to be included by reference.

The housing 110 of the fixture 100 is normally recessed into the ceiling such that one or more lamp tubes may be mounted within the fixture. The upper interior surface of the housing 110 reflects the light emitted from the lamp tubes 112 out of the fixture 100 for maximum lighting effect.

At opposite ends of the fixture 100 are sockets 114 into which the lamp tubes 112 are plugged. The lamp tubes 112 have pins (not shown) at each end that are inserted into the sockets 114 and then the tube is rotated such that the pins lock into place in the sockets. The distance between the sockets 114 is a standard distance for the lamp tubes to be mounted in the fixture.

In most lamp fixtures 100, a ballast circuit is incorporated into the fixture. In FIG. 1, the ballast is located under the ballast cover 118. The ballast circuit, powered by conventional AC power, converts the line power into a higher frequency driving signal that energizes the lamp tubes and causes them to emit light. The electrical driving signal from the ballast is conveyed to the lamp tubes by wires (not shown) running within the housing 110 and connected to the sockets 114.

In order to avoid replacing the entire fixture when a facility changes (for example) from the older, less efficient T-8 or T-12 lamp tubes to the new, more efficient T-5 style, the distance between the sockets in the fixture must change because the replacement T-5 lamps are shorter than the older lamps. The present invention is a solution to that problem. It also allows flexibility in the number and positioning of the new lamps.

Figure 2:
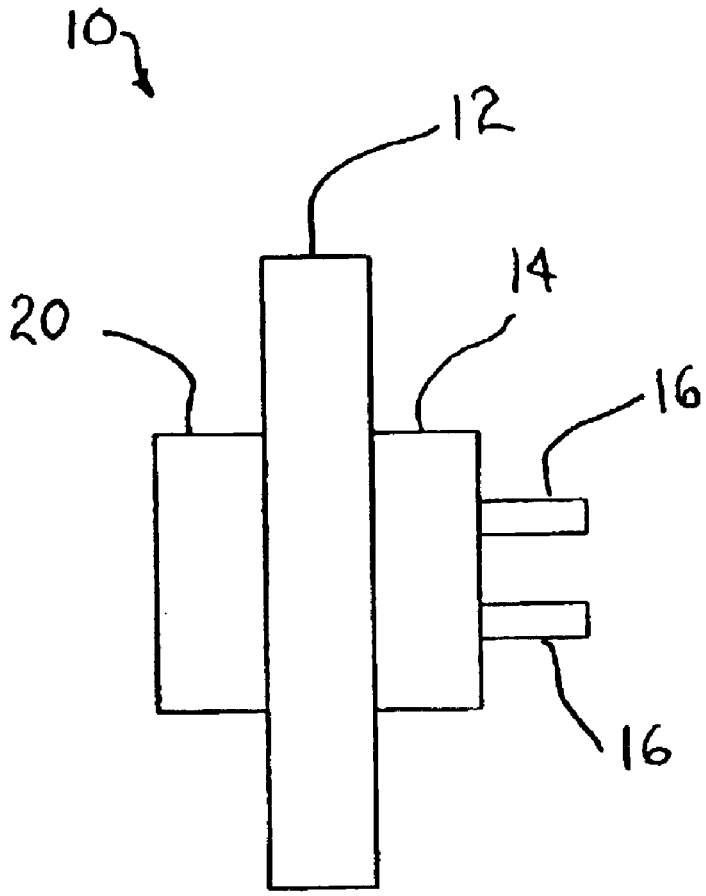
FIG. 2 is a side elevation of the adjustable assembly of the invention.
Figure 3:
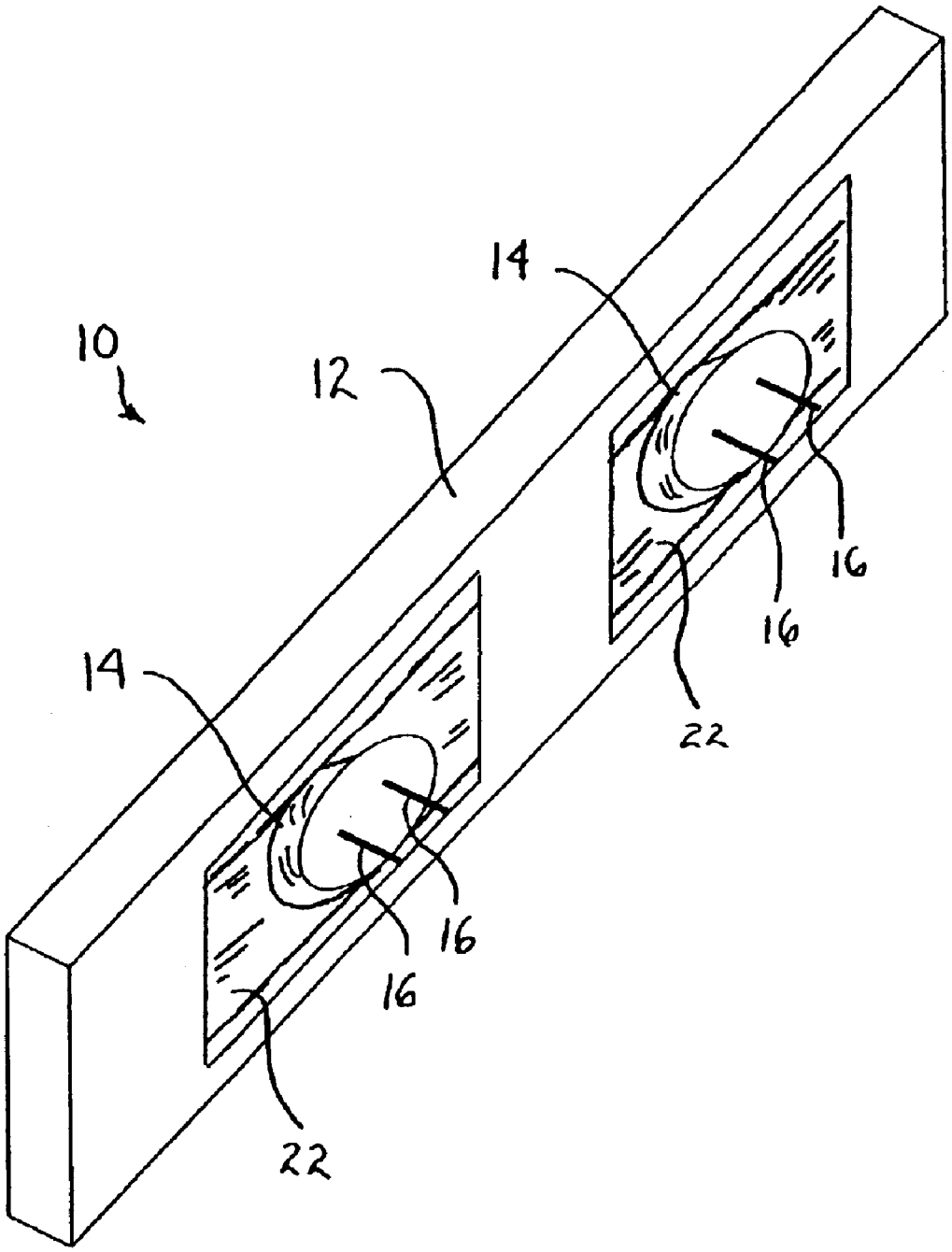
FIG. 3 is a perspective view of the plug side of the adjustable assembly of the invention.

The invention is described with reference to FIGS. 2–5. In FIG. 2, the conversion apparatus 10 of the invention is shown in side elevation and comprises a bar 12, a plug 14 having pins 16 protruding from it, and a socket 20. The bar 12 may have one, two or more sets of plugs 14 and sockets 20 mounted along its length. The plugs 14 can be rotated. FIG. 3 shows the invention in a form having two plugs 14 on one side of the bar. The plugs 14 are situated to engage with the sockets in the old light fixture. When engaged in the old light fixture sockets, the plugs are rotated to lock the pins 16 in the old socket just as a lamp tube would be locked in place.

The position of the plugs 14 on the bar 12 may be adjusted. Each plug 14 is mounted on a slide 22 that is disposed within the bar. The slides 22 are independent of each other so that each plug 14 may be moved laterally without regard to the other. This feature allows the conversion apparatus 10 to be adapted to fit within various light fixtures in which the old sockets may be spaced apart by varying distances, making the conversion apparatus 10 of the invention versatile in application.

Figure 4:
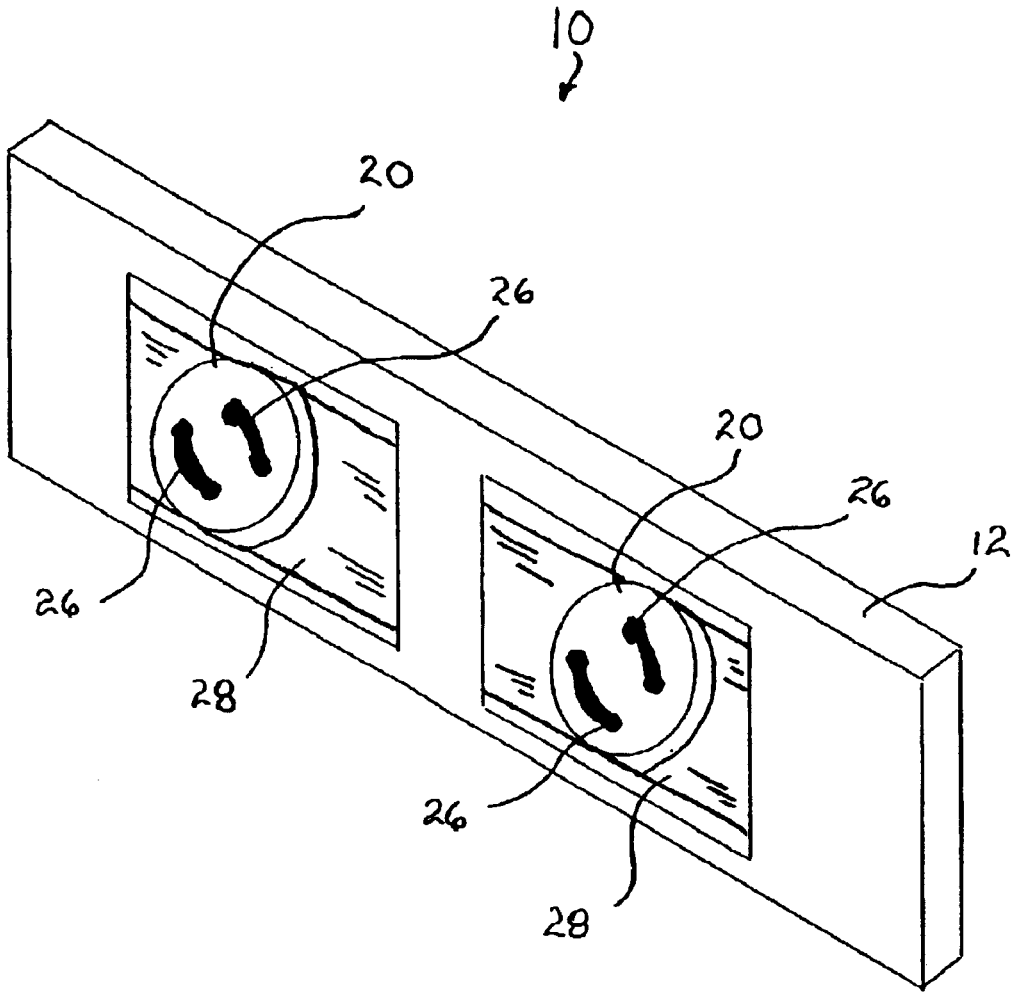
FIG. 4 is a perspective view of the receptacle side of the adjustable assembly of the invention.

FIG. 4 shows the other side of the example conversion apparatus 10 shown in FIG. 3. The apparatus 10 has two sockets 20 on this side of the bar 12. Each socket 20 comprises the necessary grooves or tracks 26 in which the pins of a lamp tube may be engaged and locked to mount a lamp in the light fixture. There are various designs of such grooves, tracks and similar mounting means known to those skilled in the art; the design of the grooves shown in FIG. 4 is merely exemplary. As on the opposite side of the apparatus 10, each of the sockets 20 is mounted on a slide 28. The slides 28 are independent of each other such that each of the sockets 20 may be moved laterally independent of the other.

Figure 5:
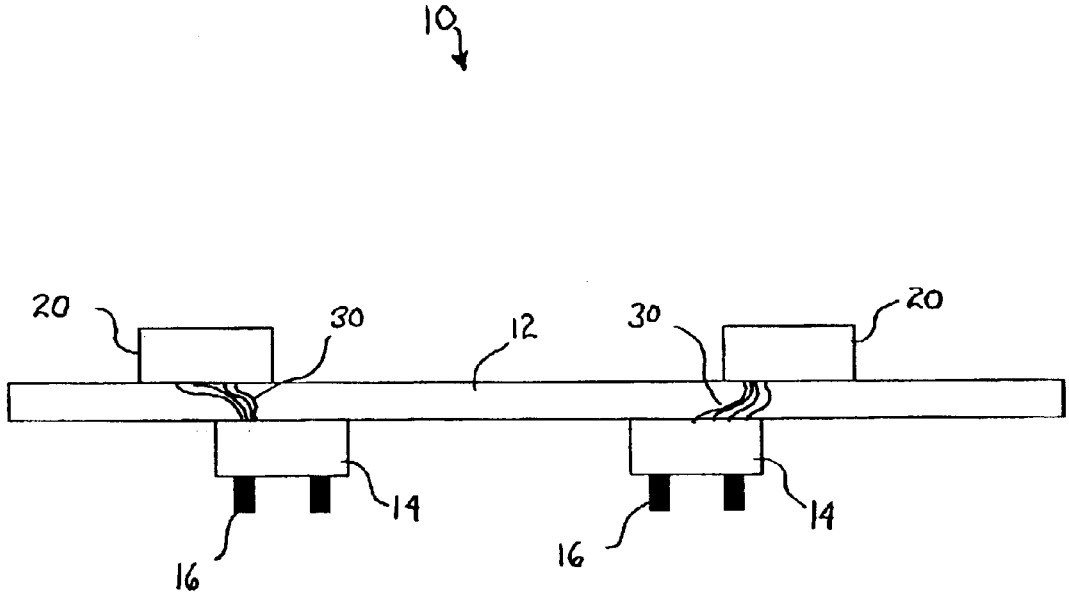
FIG. 5 is a top plan view of the adjustable assembly of the invention.

FIG. 5 indicates the presence of wiring 30 that may connect the plugs 14 to the sockets 20 to pass the energizing electrical signals from the ballast through the old sockets in the light fixture and through the plugs 14 and into the sockets 20 in the conversion apparatus. Alternatively, the wiring in the conversion apparatus may be connected directly from a replacement ballast to the one or more sockets 20 in the conversion apparatus through wiring that passes through the bar 12 of the apparatus. Or perhaps the wiring can be routed directly to each new socket 20 from a ballast as necessary. In any event, it is understood that there may be wiring within the bar 12 of the conversion apparatus 10 in order to energize the lamp tubes. An example of a wiring conversion is described below (see FIGS. 8, 9 and 10 and accompanying discussion).

The initial aspect of the invention, then, is the conversion apparatus that plugs into the sockets in an old tube-type light fixture, changing the distance between the sockets to accommodate the shorter new light tubes so that the entire fixture need not be replaced. The conversion apparatus plugs can be moved laterally to be used in various fixtures where the distance between sockets is different, or to skip over a socket in the old fixture entirely. In the latter case, a fixture that once mounted three lamp tubes may converted into a fixture for only two tubes.

The number of plugs on the conversion apparatus need not match the number of sockets in the old fixture. In various configurations, the conversion apparatus of the present invention can be made with more or less plugs than the sockets in the old fixture, and with more or less sockets for new lamps than were in the old fixture.

For example, an old fixture with four lamp socket pairs can be converted into a fixture with three new lamps or with five new lamps. The spacing can be changed by adjusting the position of the sockets in the conversion assembly using the range of motion provided by the slides.

Figure 6:
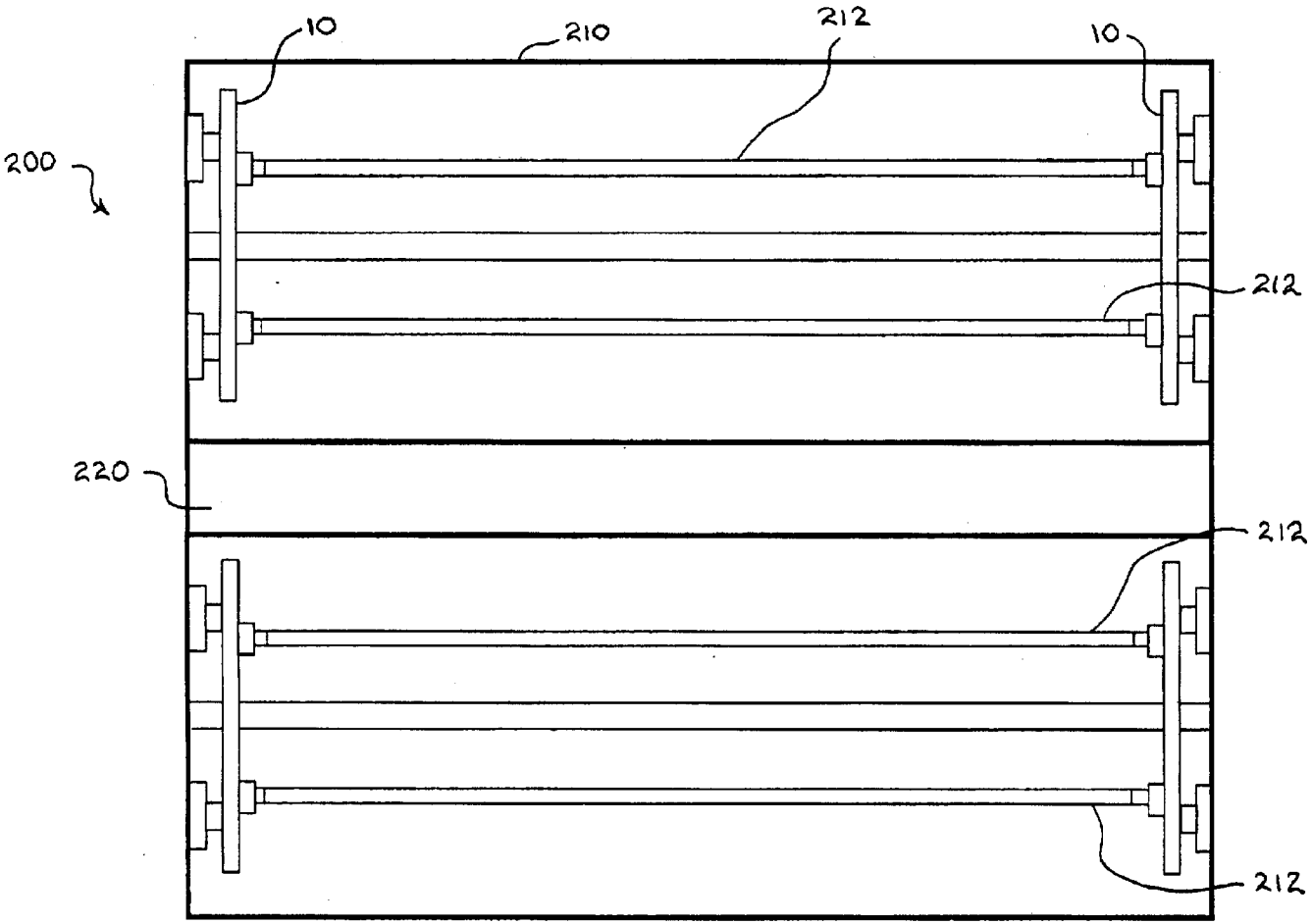
FIG. 6 is a bottom plan view of a light tube assembly with the adjustable assembly of the invention installed in it.

FIG. 6 is an illustration of the conversion of an old standard fixture into a more modern light fixture 200 using the invention. The conversion apparatus 10 plugs into the sockets in the standard fixture 210. The new lamp tubes 212 are mounted in the sockets of the conversion apparatus, which can be positioned whereever along the bar of the conversion apparatus they need to be assume the proper location in the fixture 210 for best light reflection out of the fixture. A ballast cover 220 separates the fixture into two halves and contains the ballast electronics for energizing the lamps 212. (Ballasts can be otherwise located in various fixtures.)

If the standard fixture 210 had three socket locations for lamp tubes, that does not dictate that three new lamps need to be provided by the conversion apparatus. The conversion can change the fixture from three lamps to two, four to three, two to four, or any other number by configuring the conversion apparatus as needed to accomplish the result.

Figure 7:
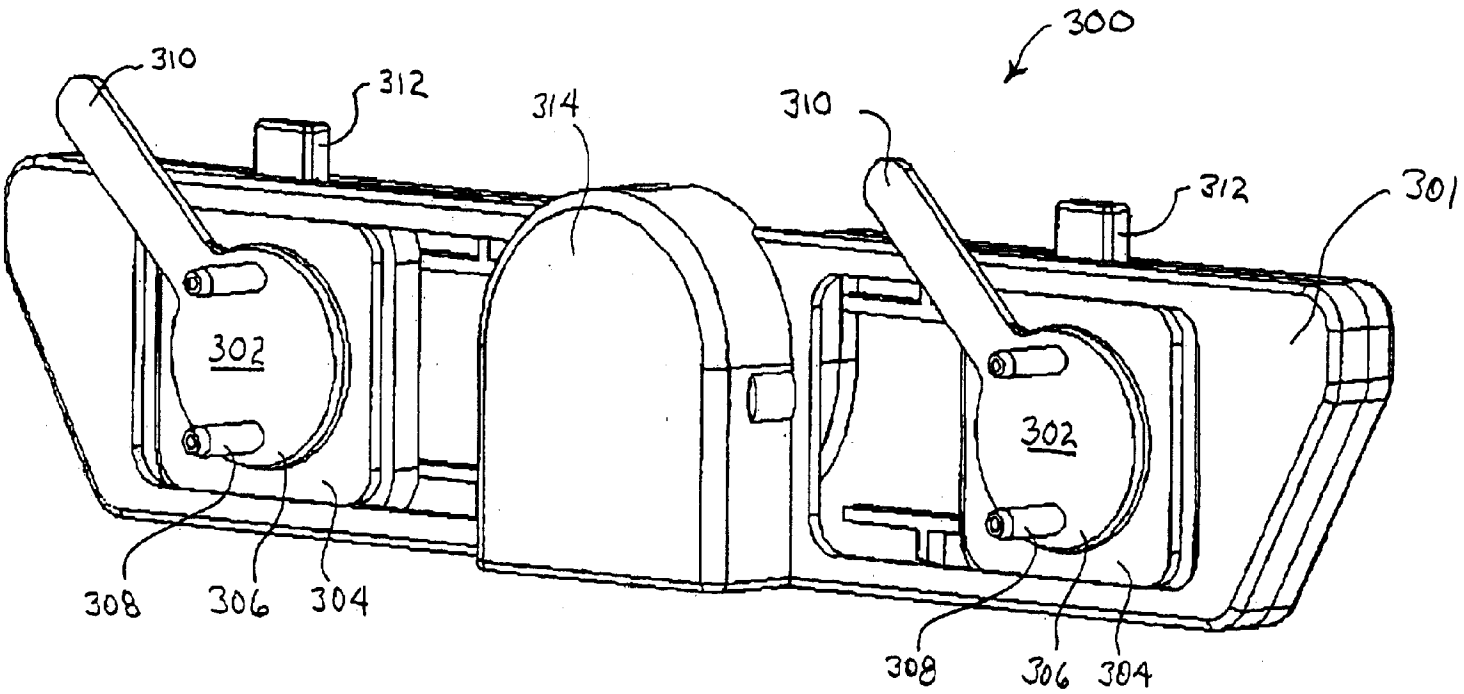
FIG. 7 is a perspective view of an advanced embodiment of the invention.

An advanced example of a two-T-8 to one-T-5 conversion apparatus according to the invention is shown in FIG. 7. The conversion apparatus 300 converts a two T-8 lamps fixture to a one T-5 lamp fixture by providing two T-8 sized mounting pin assemblies 302 to mount the conversion apparatus in the light fixture. Each assembly comprises a frame 301, a slidable mount 304, a rotating pin disk 306 carrying the connecting pins 308 with a control arm 310 extending from the rotating disk 306 for locking the pins into place in the old fixture (not shown), and a T-5 lamp holder 314.

The conversion apparatus of FIG. 7 mounts into two T-8 fixture connectors in a lighting fixture. The mounting pin assemblies 302 operate by positioning the slidable mounts 304 to match the position of the T-8 connectors in the fixture. The pins 308 on the slidable mounts 304 are inserted into the T-8 connectors, then are locked by rotating the pins using the control arms 310 connected to each rotating disk 306. The electrical power from the ballast (not shown) is routed by wire through the frame 301 of the apparatus 300 to the T-5 lamp holder 314. A single T-5 lamp is mounted in the lamp holder 314 on the side not shown in the Figure. Using two such apparatus as shown in FIG. 7, a fixture that once required two T-8 lamps can be retrofitted to accommodate a single T-5 lamp, saving the expense of one lamp per fixture and consuming less power in the process. Other conversion ratios are possible, of course (e.g., 4 to 2, 3 to 2, 4 to 4, etc.).

Figure 8:
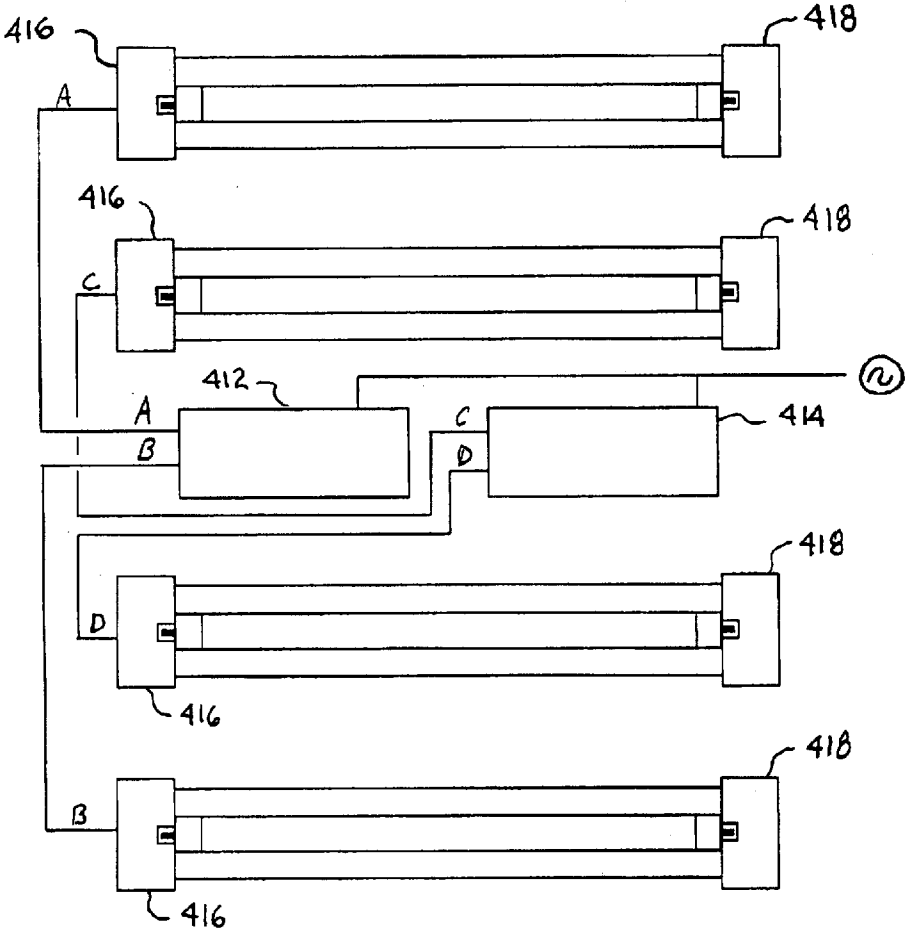
FIG. 8 is a schematic diagram of a new power system for a converted fixture according to the invention.

FIG. 8 is a schematic diagram that introduces the description of another aspect of the invention, the electrical conversion from the standard fixture ballast power to a new power system for the new lamps. In a standard lamp tube assembly having four lamps, there might be found two ballasts 412, 414 that provide energizing signals (A, B, C, D) to the lamps through the respective sockets 416 and return sockets 418 (which rout the return signals (not shown) back to the ballasts).

Figure 9:
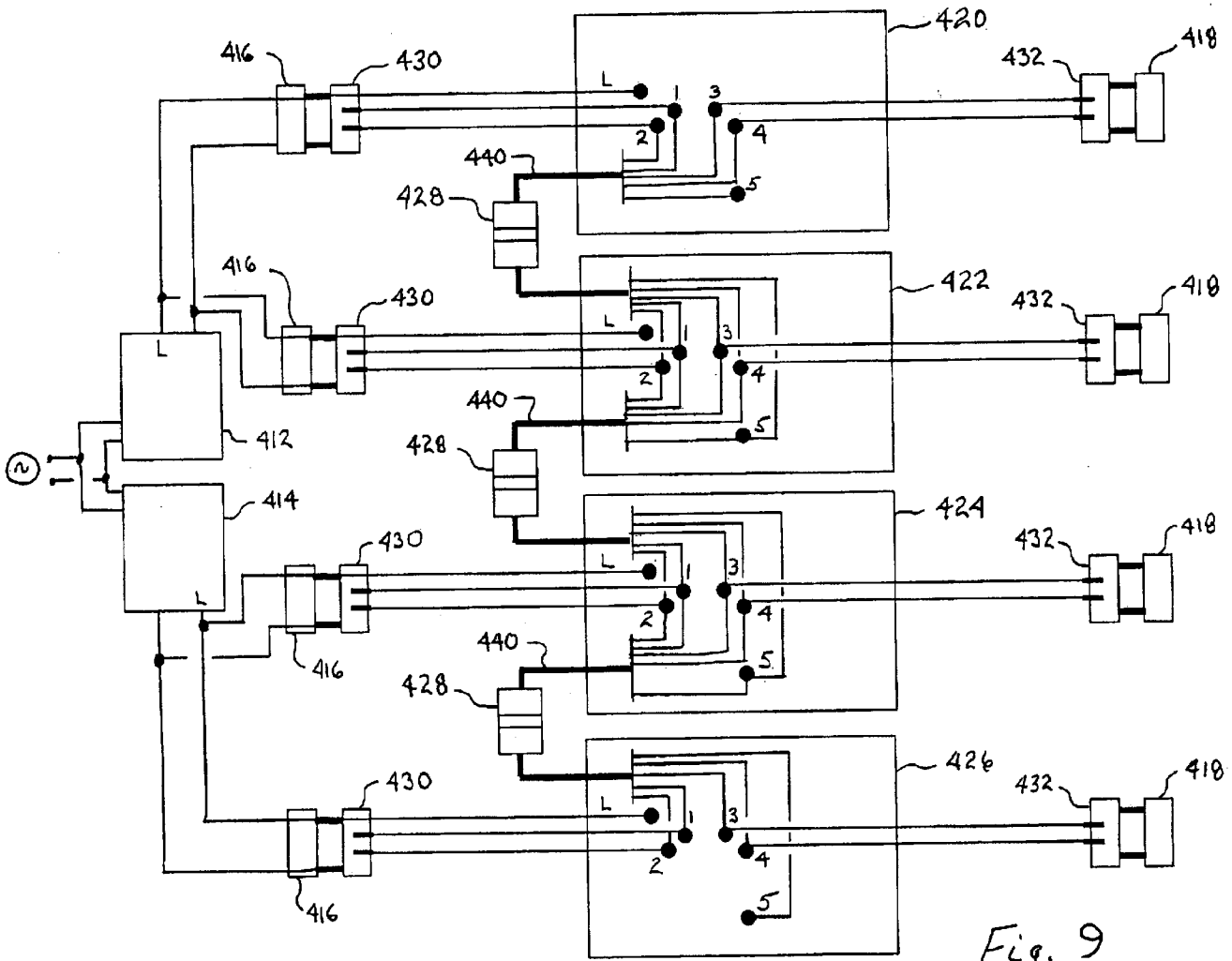
FIG. 9 is a schematic diagram of a master-slave ballast conversion assembly of the present invention.

The example depicted in FIG. 9 shows a 4 to 4 lamp electrical conversion in schematic form that is a modification of the elements of FIG. 8. In the diagram of FIG. 9, the existing fixture has two ballast controllers 412, 414 providing controlled power to the four old lamp tube sockets 416. The diagram schematically represents the neutral side 418 of each old socket, each of which would carry the return connections (not shown) to the ballasts that close the circuit.

In the conversion apparatus of the present invention, the electronics of the converted assembly are dramatically changed. In the conversion, the old sockets 416, 418 are connected and converted to new sockets 430, 432 for holding new lamps. The old ballasts continue to provide their primary energy signal "L" to the old sockets 416 (and receive the returns through sockets 418). The primary ballast energy L is passed through the old sockets 416 and is wired to a new ballast circuit assembly 420, 424, 426, 428 for each new lamp. Each new ballast circuit uses the input L to stimulate the creation of new control energy that is represented in the diagram of FIG. 9 as five signals:

1: pre-heat
2: oscillator
3: protection
4: ground
5: shared DC

These power signals are generated on a first circuit board 420, then routed in serial fashion through a cable 440 connected from board to board (e.g., 420 to 422, 422 to 424, 424 to 426) using connectors 428. In this manner, there is formed a master-slave ballast circuit wherein a master ballast control (e.g., 420) is established and one or more lamps are controlled as slaves from the master ballast (as are the three slave lamps that are connected to boards 422, 424 and 426 in FIG. 9). Each of the ballast circuit boards 420, 422, 424, 426 are wired to the power sockets 430, 432 that hold the new lamps in the conversion apparatus. As for the physical assembly described for mounting the lamps, the ballast conversion circuits can be provided for any number of lamps through cable and connectors installed into the conversion apparatus. The cable and connectors installed in the conversion apparatus form a "daisy-chain" ballast control for energizing the new lamps.

Figure 10:
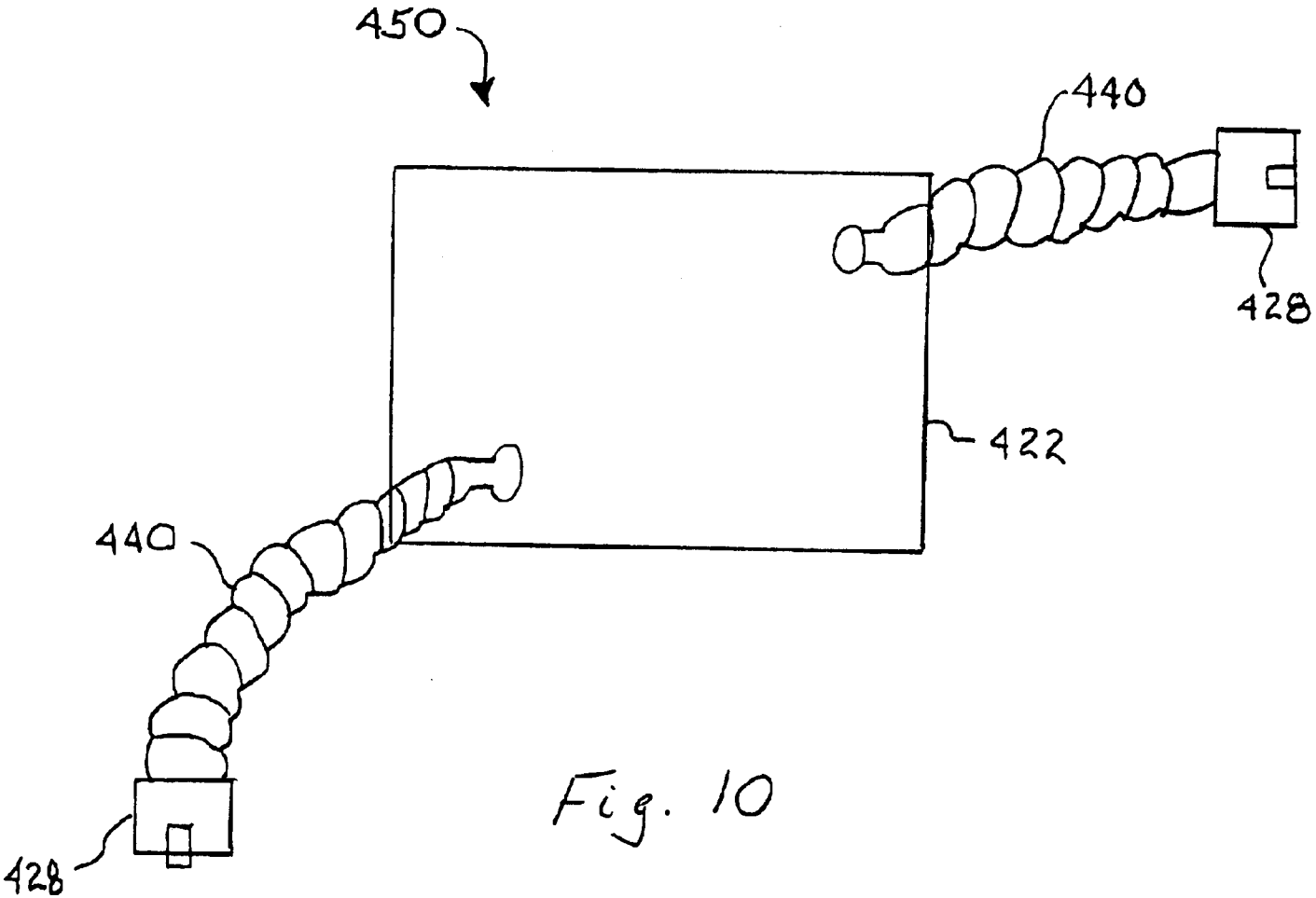
FIG. 10 is a plan view of a ballast circuit board and cable/connector assembly of the present invention.

The assembly that represents the combination of a circuit board with a cable and connector is an aspect of the present invention. As shown in FIG. 10, the circuit board 422, cable 440 and connector 428 can be made into an integral assembly 450 that is generic to installation in thousands of conversion apparatus. The cable assembly 450 can be formed in variants that have only one cable connected to the board 420 if the board is either the master circuit board (board 420 in FIG. 9) or the terminus of the chain of slave boards (as is board 426 in FIG. 9). The cable assembly shown in FIG. 10 represents one of the slave boards 422, 424 with both an input and output cable connection in the chain of slave boards.

Figure 11:
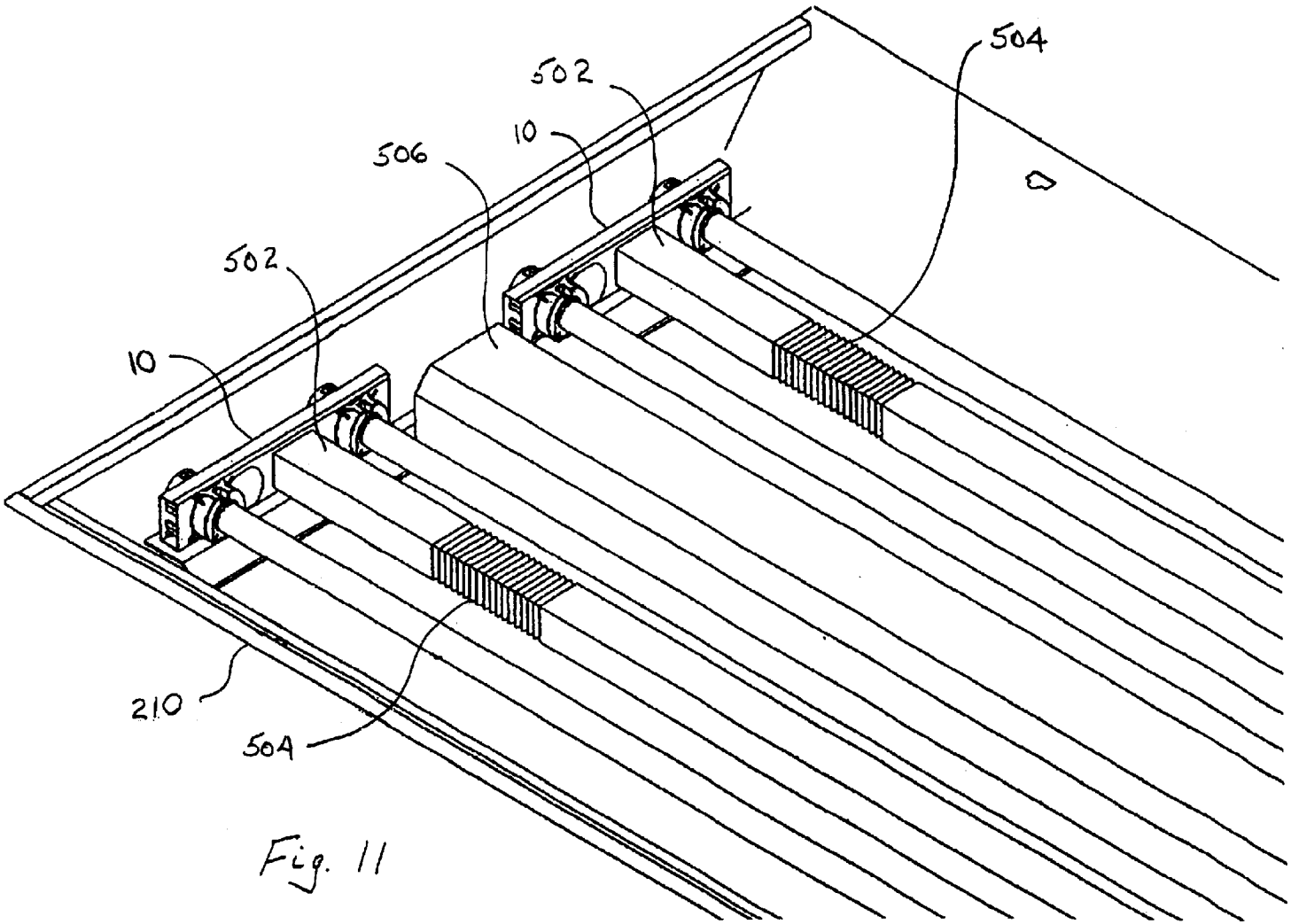
FIG. 11 is a perspective view of a conversion apparatus of the present invention including an enclosure for the ballast conversion assembly.

The board/cable assembly can be mounted in an enclosure that can be installed as part of the conversion apparatus. FIG. 11 shows such an enclosure fitted to a conversion apparatus of the present invention. FIG. 11 shows a conventional fixture 210. Into this fixture 210 the conversion apparatus 10 shown and described in connection with FIGS. 3–7 is installed to accept the new, smaller and more efficient lamp tubes. The original ballast cover 506 is mounted in the middle of the fixture 210. Added to the arrangement already described is an enclosure 502 for holding the circuit boards (not shown) for the converted master-slave ballast. The cable assemblies that connect one circuit board to another can be routed along the interior of the fixture around the sockets and contained, as much as possible, within the enclosures 502. Wiring from the interior of the enclosure can be routed through the socket conversion apparatus 10 to the sockets.

The enclosure shown in FIG. 11 is formed with a telescoping section 504 that permits the enclosure to be fitted within an existing fixture 210 as an element of a conversion according to the present invention. The enclosure can be spring-loaded along its length to create the outward force necessary to expand the telescoping section 504 and secure the enclosure within the fixture 210. There are numerous other methods of securing the enclosure 502 within the fixture 210 that will be evident to persons skilled in the relevant art.

Other variations of the apparatus can be conceived that provide the beneficial results of the invention while not deviating from the basic design features described herein. For that reason, resort must be taken to the claims to determine the legal scope of the invention.

What is claimed is:

1. A kit for converting a tube lamp fixture from a first to a second size of lamp tube, said kit comprising:

a conversion apparatus comprising a bar in which one or more lamp plugs is disposed in slidable arrangement on a first side of said bar, and in which one or more lamp sockets is disposed in slidable arrangement on a second side of said bar, each of said one or more sockets disposed in a position independent of the position of said one or more lamp plugs;

a master-slave ballast conversion assembly, said assembly comprising a master circuit board having a cable attached to it, said cable having a free end with a first connector, said assembly further comprising one or more slave circuit boards, said one or more circuit boards being connected together through cables between them and connectors securing each cable to the next with at least one of said slave circuit boards being connected to the cable attached to the master circuit board through the first connector;

one or more enclosures for said master-slave ballast conversion assembly, said enclosure being attached to said fixture and enclosing one or more of the ballast conversion circuit boards.

2. An apparatus for permitting an existing tube lamp fixture to accommodate a smaller tube size, said apparatus comprising:

a bar in which one or more lamp plugs is disposed in slidable arrangement on a first side of said bar, and in which one or more lamp sockets is disposed in slidable arrangement on a second side of said bar, each of said one or more sockets disposed in a position independent of the position of said one or more lamp plugs.

* * * * *